United States Patent [19]
Schevey et al.
[11] 4,279,279
[45] Jul. 21, 1981

[54] FILLING MACHINE AND METHOD FOR LOW PARTICULATE CHEMICALS

[75] Inventors: William R. Schevey, Honesdale; Robert G. Weslowski, Boothwyn, both of Pa.; John D. Morentz, Wilmington, Del.

[73] Assignee: Allied Chemical Corporation, Morris Township, Morris County, N.J.

[21] Appl. No.: 82,246

[22] Filed: Oct. 5, 1979

[51] Int. Cl.[3] ..... B65B 3/26
[52] U.S. Cl. ..... 141/5; 141/172; 141/198; 141/286
[58] Field of Search ..... 141/5-8, 141/39, 54, 14, 230, 250-310, 367-386, 129-191, 198, 206-229, 37, 40-64

[56] References Cited

U.S. PATENT DOCUMENTS

| | | | |
|---|---|---|---|
| 1,442,405 | 1/1923 | Hawthorne . | |
| 2,905,363 | 9/1959 | Newey et al. . | |
| 3,182,691 | 5/1965 | Vergobbi et al. | 141/5 |
| 3,554,388 | 1/1971 | Thompson . | |
| 3,927,700 | 12/1975 | Trinne et al. | 141/5 |

OTHER PUBLICATIONS

Pneumaflow-Pneumatic Seale Corporation, Bulletin #185.
Pneumaflow-Pneumatic Seale Corporation, Bulletin #50F.
Pneumatic Sketch-Pneumatic Seale Corporation, Plate #4.

*Primary Examiner*—Houston S. Bell, Jr.
*Attorney, Agent, or Firm*—Alan M. Doernberg; Jay P. Friedenson; Arthur J. Plantamura

[57] ABSTRACT

A plurality of bottles (125) or other containers are delivered and aligned under a plurality of filler heads (110) each having a liquid feed channel (113) extending vertically downward to outwardly opening apertures (119) and also an inert gas feed channel (116) extending vertically downward to a lower end (117) below the apertures (119). The bottles (125) are moved upward (134) and chemicals are delivered into the bottles (125) through the liquid feed channel (113) and apertures (119). When the liquid level (127) of each bottle reaches the lower end (117), the back pressure in the inert gas feed channel (116) is sensed (123) and the liquid flow is shut off (120). Contamination of the bottles by particulates is minimized since no moving parts are required above the level of the bottles and because no contact is required between the filler heads and the bottles.

6 Claims, 9 Drawing Figures

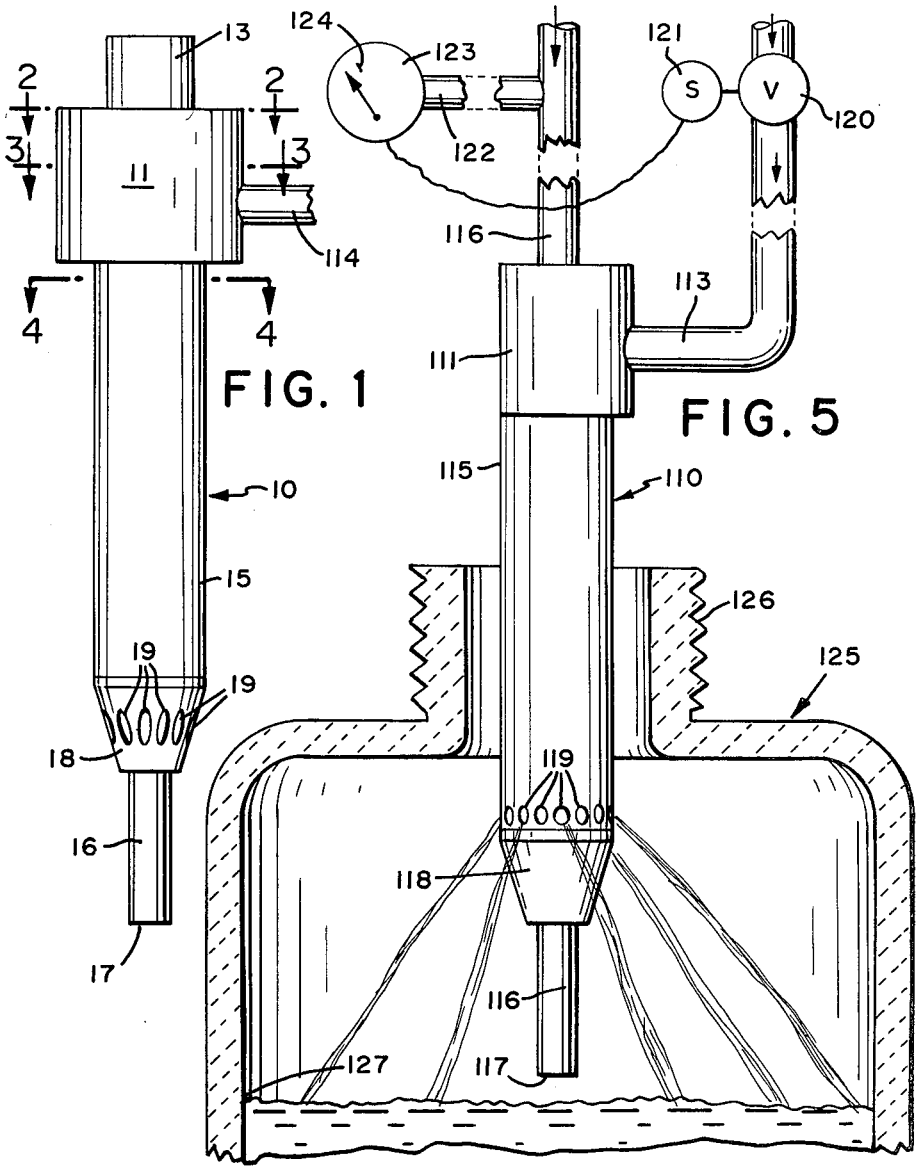
FIG. 1
FIG. 5
FIG. 2
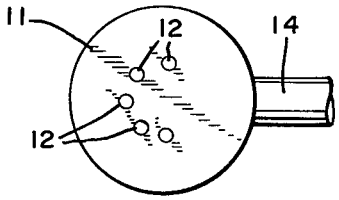
FIG. 3
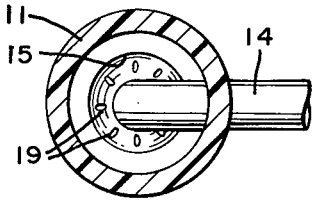
FIG. 4
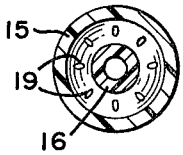

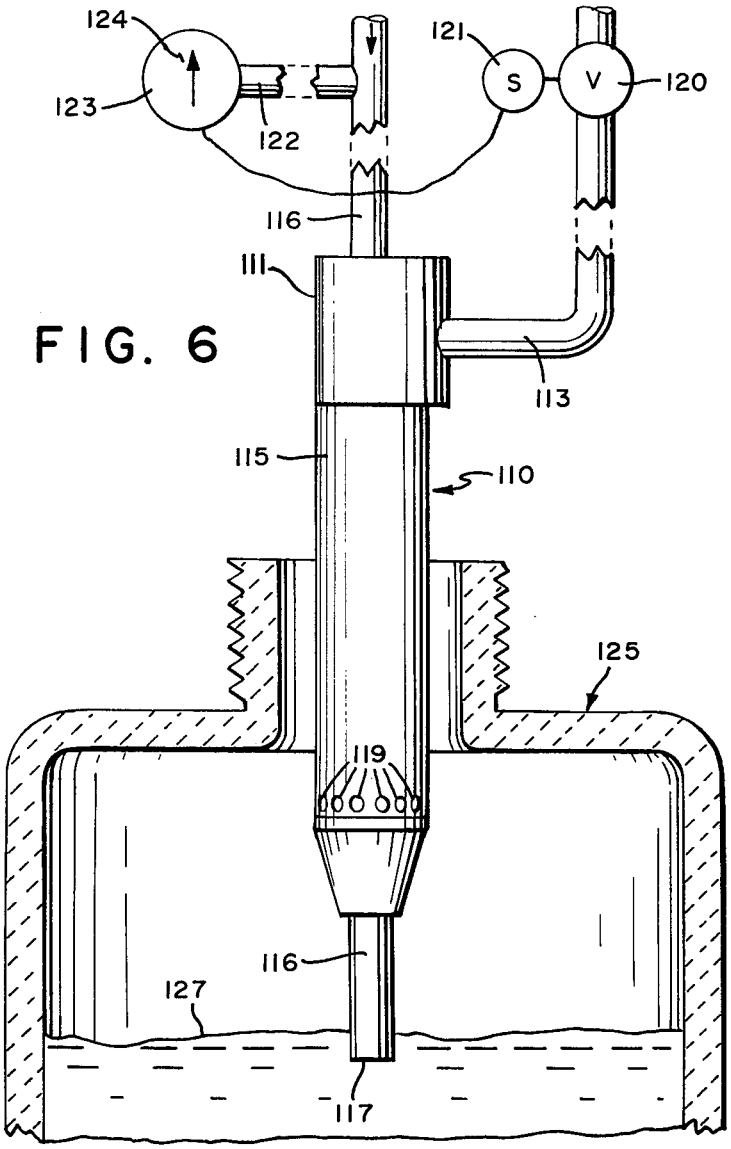
FIG. 6
FIG. 4B
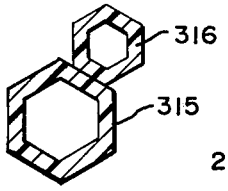
FIG. 4A
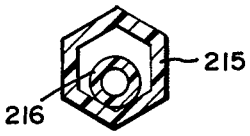

FILLING MACHINE AND METHOD FOR LOW PARTICULATE CHEMICALS

BACKGROUND OF THE INVENTION

Containers such as bottles are conventionally filled by one of two types of machines. In straight filling machines, a plurality of bottles is carried along a conveyor belt down a straight path and a plurality of filler heads contact the top of the bottles by moving downwardly and horizontally along with the bottles. Once a filler head is secured on a bottle, liquid is fed into the bottle through the filler head from one or more reservoirs, with filling continued either for a fixed time or until a certain level has been reached, generally by the sensing of overflow from the bottle.

In the second type of filling machine, bottles are received one at a time onto a rotary device, frequently by lifting each bottle individually up to a filler head. While contact is usually made between the bottle neck and the filler head or an aligning collar attached to the filler head, in some cases no such contact is made. The bottle and filler head then travel together along a circular path while liquid is fed into the bottle. Again, completion of filling is usually sensed by overflow.

A series of machines manufactured by Pneumatic Scale Corporation employs a back pressure sensing means for determining that a desired level has been reached in the bottle. In those machines, an aligning collar aligns each bottle on a straight conveyor or a rotary star wheel under a filler head, the filler head moves downwardly into the bottle, and the flow of liquid commences. When the desired level is reached, back pressure is sensed by a "low pressure" gas flow and, simultaneously, the liquid flow ceases and the filler head retracts upward from the bottle.

All of the above bottle filling machines employ moving parts above the level of the bottle neck. It is important, however, for some applications such as semiconductor processing that chemicals be available with extremely low particulate contamination counts. The use of conventional bottle filling machines to package such chemicals introduces particulate contamination into the bottles either because of particulates generated when an adjusting collar or other device contacts the bottle neck or by movement of machinery parts associated with the filler head.

BRIEF DESCRIPTION OF THE INVENTION

The present invention includes an apparatus for automatically filling bottles with high purity liquid which comprises:

(a) a first plurality of filler head assemblies each defining a liquid feed channel extending vertically downward to a second plurality of circumferentially spaced, outwardly opening apertures and also defining an inert gas feed channel extending vertically downward adjacent the liquid feed channel to a lower end below the outwardly opening apertures;

(b) a vertically moveable platform beneath said first plurality of filler head assemblies;

(c) bottle delivery means for delivering and aligning a first plurality of bottles onto said vertically moveable platform with the opening of each bottle being aligned beneath the apertures and said lower end of a corresponding filler head assembly without contact being made between the bottle and the filler head assembly;

(d) lift means for lifting said vertically moveable platform when said first plurality of bottles are aligned beneath said first plurality of filler heads upwardly until each lower end and associated second plurality of apertures is within a bottle without contact being made between the bottle and the filler head assembly;

(e) liquid feed means for delivering liquid to and through said liquid feed channel and said outwardly opening apertures into each bottle when said vertically moveable platform is raised; and (f) inert gas means for delivering a flow of inert gas at substantially constant pressure through each said inert gas feed channel and for sensing back pressure of said inert gas and for shutting off the flow of liquid to the adjacent liquid feed channel at a location remote from said filler head assemblies when back pressure of inert gas caused by the liquid level in a bottle reaching said lower end is sensed.

The present invention also includes a method for automatically filling bottles with high purity liquid. The method comprises delivering and aligning a first plurality of bottles beneath a first plurality of filler heads, lifting the first plurality of bottles until the lower end of each filler head is received within a bottle without contact being made between a filler head and a bottle, feeding liquid to and through each filler head into the corresponding bottle, sensing when a selected level of liquid is reached in each bottle and shutting off the flow of liquid to each filler head at a location remote from the filler head when the liquid level in the corresponding bottle has reached the selected level.

The process of the present invention is accomplished without either mechanical moving parts over the bottle openings or contact between the filler head or associated structures and the bottle, either of which can generate particulate contamination which falls into the bottle.

BRIEF DESCRIPTION OF THE DRAWING

FIG. 1 is an elevational view of a filler head according to one embodiment of the invention.

FIG. 2 is a plan view taken along line 2—2 in FIG. 1.

FIG. 3 is a plan view taken along line 3—3 in FIG. 1.

FIG. 4 is a plan view taken along line 4—4 in FIG. 1.

FIG. 4*a* shows a hexagonal outer tube.

FIG. 4*b* shows two tubes with hexagonal cross-sections.

FIG. 5 is an elevational view of a bottle being filled according to a second embodiment of the invention.

FIG. 6 is a view similar to FIG. 5 of a bottle after filling has been completed.

DETAILED DESCRIPTION OF THE INVENTION

Figure 7:
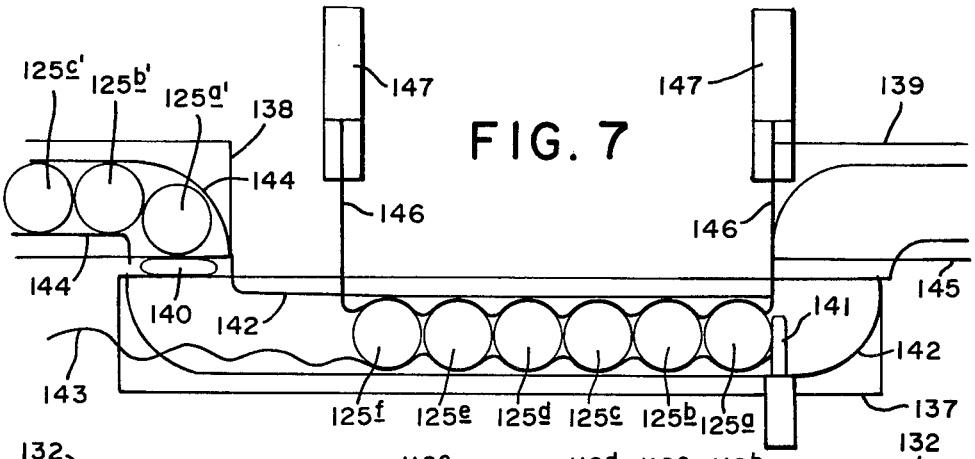
FIG. 7 is a plan view of a machine according to the present invention.

In the apparatus of the present invention, the bottles are said to be supported on a vertically moveable platform. The term "platform" is not intended, however, to preclude structures such as conveyer belts which are vertically moveable. In the preferred embodiment illustrated in FIGS. 7–9, conveyer assembly 137 acts to form such a platform by the top belt. Thus, when fixed in the position shown in the Figures, the top belt surface is the "platform." Once the bottles are filled and lowered, however, the conveyor 137 is activated to move the full bottles away from the filler heads and to bring a set of empty bottles under the filler heads. When moving, the conveyer may be considered a part of the "delivery means."

Also, the "delivery means" may be thought of as, first, delivering bottles onto the platform beneath the filler heads and, second, aligning the bottles beneath the filler heads to a precision that will enable the bottles, when lifted, to surround the lower ends of the filler heads without making contact. While the conveyer 137 may perform only the delivering function and the aligner bar 146 and guide bars 142 may perform only the aligning function, other structures such as the worm screw 143 and stops 140 and 141 may perform both functions.

Accordingly, it is convenient to consider all of these devices as part of a single means performing both functions.

In the apparatus of the present invention, it is preferred that all structures associated with holding each bottle in a horizontal position beneath the corresponding filler head be vertically moveable with the platform that supports the bottle. Thus, in FIGS. 7–9 below, conveyer 137, guide bars 142, worm screw 143, pistons 147 (which control aligner bar 146) and stop 141 are all fixed directly or indirectly to tray assembly 135 to be vertically moveable therewith. Skirts 136*a* and 136*b* are preferably also fixed to tray assembly 135.

In comparing spacings between filler heads with other spacings such as between bottles, between recesses formed by an aligner bar or between turns in a worm screw, it is the intention herein to measure from the center of one structure to the center of the adjacent similar structure. Thus, two filler heads are considered spaced apart by the distance between their cylindrical axes.

DESCRIPTION OF THE PREFERRED EMBODIMENTS

The filler head shown in FIG. 1 may be made of any conventional material, but is preferably made of a polymeric material compatible with all of the liquids which one desires to fill in the bottles using the filler head. Thus, when corrosive acids are to be filled, the filler head is preferably of a fluoropolymer such as poly (ethylene-chlorotrifluoroethylene), polytetrafluoroethylene, polyvinyl chloride, a polyamide, a polyolefin such as polypropylene or an ultra high molecular weight polyethylene or other resistant polymeric material. If it is not desired to fill corrosive acids with the machines, metal parts may also be used.

Referring to FIGS. 1–4, the filler head 10 has a cylindrical top portion 11 vertically disposed. The top face of top portion 11 is closed off except for a plurality of circumferentially spaced holes 12 extending only partially around a circle having its center along the axis of the cylindrical top portion 11 and having a radius of about one half the radius of the cylindrical top portion 11. A liquid feed tube 13 abuts against the top phase of the top portion 11 of filler head 10 such that the interior of the feed tube 13 communicates with the holes 12. An inert gas feed tube 14 extends horizontally through a hole in the side of the top portion 11 beneath a portion of the top face not provided with holes 12. The main portion 15 of the filler head is cylindrical and extends vertically downward from and communicates with the top portion 11 having a radius somewhat smaller than the radius of the top portion 11 but somewhat larger than the radius of liquid feed tube 13. An inert gas sensor tube 16 extends vertically down the interior of the main portion 15 and communicates at its upper end with the inert gas feed tube 14. Since the inert gas sensor tube 16 has a radius less than that of the circle formed by the holes 12, it will be appreciated that liquid may flow directly from holes 12 through the annular space outside of the inert gas sensor tube 16 and inside of the main portion 15 of the filler head 10. At the base of the main portion 15, a tapered portion 18 of the feed tube 10 is provided with circumferentially, spaced outwardly opening apertures 19 communicating with the annular liquid flow space. The inert gas feed tube 16 extends downwardly below the end of the tapered portion 18, and thus below the apertures 19 to a lower end 17.

A variation of the filler head 10 is shown in FIGS. 5 and 6 in operation. In this modification, the inert gas feed tube 116 extends from above the top portion 111 of the filler tube 10 inwardly within the top portion 111, main portion 115 and tapered portion 118 of the feed tube to a lower end 117. A liquid feed tube 113 extends through the side of the upper portion 111 such that its interior communicates with the annular space outside of inert gas sensor tube 116 and inside of the upper portion 111, the main portion 115 and the tapered portion 118 of the feed tube 110. A plurality of circumferentially spaced, outwardly opening apertures 119 are defined through either the main portion 115 at its lower end (as shown) or through the tapered portion 118 communicating with this annular liquid feed space. Upstream of the feed tube 110 and preferably at a location remote from and sealed off from the feed tube 110, the liquid feed tube 113 passes through a valve 120 controlled by a solenoid 121. A T fitting in the inert gas feed tube 116, also upstream from and preferably remote from the feed tube 110, is provided with one branch connected to a constant pressure source of inert gas (not shown) and the other end connected to a highly sensitive gas pressure sensing device such as a very sensitive photohelic pressure switch. As shown, the pressure sensing device 123 displays the gas pressure with a moveable needle in conventional fashion, and a moveable point 124 is provided. In actual practice, the display of the pressure sensed is not critical, but the important feature is that the sensor 123 be connected to solenoid 121 in a manner such that, when the sensed pressure exceeds a set value (as indicated in FIGS. 4 and 5 by point 124) solenoid 121 closes valve 120.

The operation of the filler head assembly of which filler head 110 is a part is illustrated by FIGS. 5 and 6. As described further below, a bottle 125 is aligned beneath the lower end 117 of the filler head 110 and then raised, without contact being made between the filler head and the bottle, to a level at which the neck 126 of the bottle surrounds the main portion 115 of the filler head 110. In this position the tapered portion 118, the circumferentially spaced aperture 119 and the lower end 117 of the inert gas sensor tube 116 all are within the bottles 125 beneath the neck 126. By a mechanism not illustrated, the lifting of the bottle 125 is followed by a signal causing solenoid 121 to open the valve 120 and thereby to initiate a flow of liquid product through liquid feed tube 113 down the annular space within the feed tube 110 and outside of the inert gas feed tube 116 and through the apertures 119 into the bottle 125. It will be appreciated that the umbrella of liquid flowing into the bottle 125 is circumferentially spaced by virtue of apertures 119. Inert gas is fed at constant pressure through inert gas feed 116 to lower end 117. Initially, this flow of inert gas such as nitrogen or air passes upwardly between the streams of liquid emitting from apertures 119 and between the neck 126 of the bottle 125 and the main portion 115 of the filler head 110. Accordingly, no pressure build-up occurs within the bottle. When the liquid level in bottle 125 approaches the height of the lower end 117 of the inert gas sensor tube 116, this flow of gas is impeded such that back pressure builds up in sensor tube 116. Almost instantly, this back pressure is transmitted through branch tube 122 to pressure sensor 123, exceeding the preset level shown by mark 124. The sensor 123 then causes solenoid 121 to shut valve 120, stopping the flow of liquid. Much as holding one's finger over the top of a straw filled with liquid stops the flow of liquid out of the straw, even when the straw is full, the closing of valve 120 stops the flow of liquid through filler head 110 almost immediately, holding up a column of liquid between valve 120 and apertures 119. As shown in FIG. 6, with the flow of liquid cut off, the level 127 in bottle 125 is approximately equal to the level of the bottom 117 of the inert gas sensor tube 116.

At this point, once all bottles in a group are so filled, mechanisms described below lower bottle 125 and convey and align a new bottle to a position beneath filler head 115. The new bottle is then raised to the position shown in FIG. 5.

The filler head may be of the type shown in FIGS. 1 through 4 of in FIGS. 5 and 6 or of any other type wherein sensing means is provided to sense when the liquid has reached the predetermined level without moving parts or contact between the filler head and the bottle. When the illustrated sensor gas mechanism device is used, it is sufficient that the sensor tube extend downwardly adjacent the tube defining the flow of liquid, with the two tubes not being limited to concentric cylindrical tubes as shown in FIGS. 1 through 6. Thus, for example, in FIG. 4A, a hexagonal outer tube 215 is shown with an inert gas sensor tube 216. In FIG. 4B, two tubes with hexagonal cross-sections are shown, with the smaller filler tube 316 being outside of, but adjacent the liquid feed tube 315.

Figure 8:
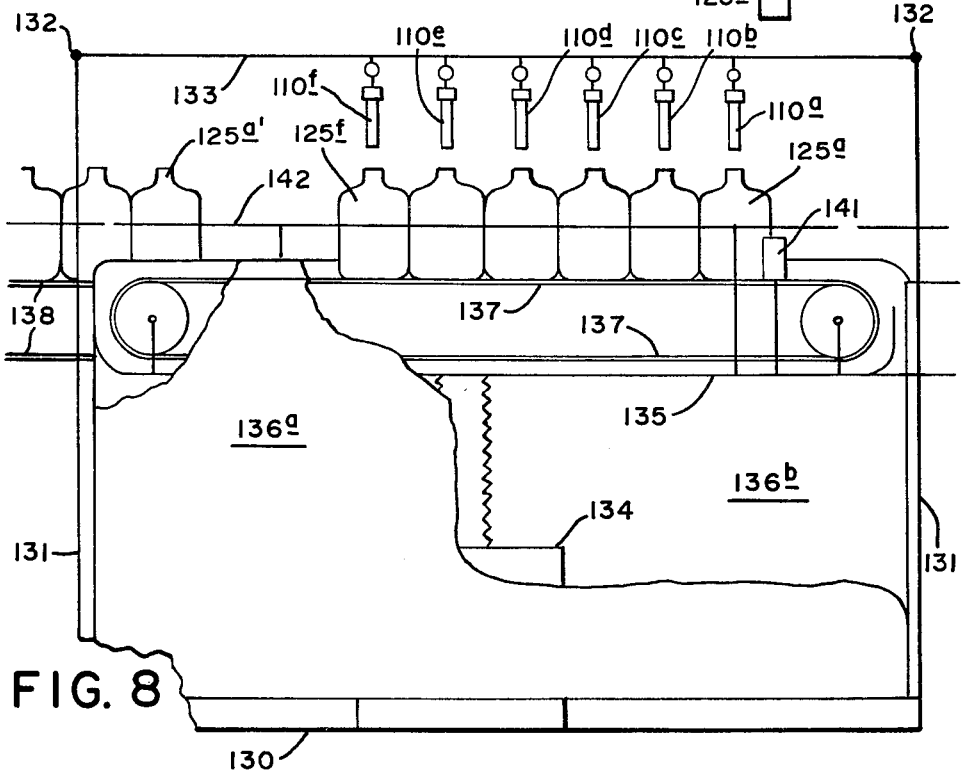
FIG. 8 is an elevational view of the machine of FIG. 7 with the bottles aligned below the filler heads.
Figure 9:
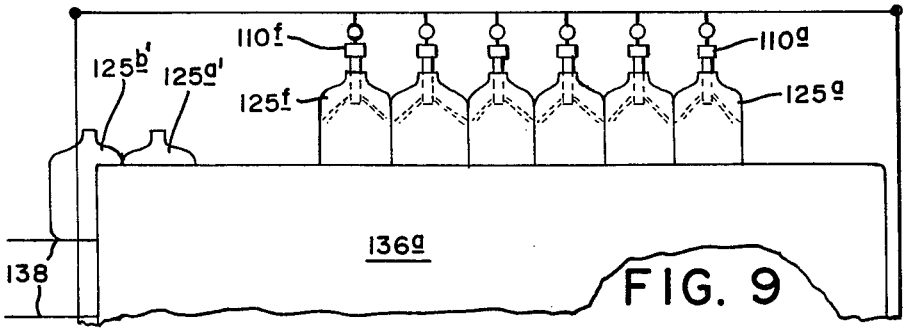
FIG. 9 is an elevational view of the machine of FIGS. 7 and 8 with the bottles raised and being filled.

With reference now to FIGS. 7–9 an overall machine in accordance with the present invention is shown. Referring first to FIGS. 7 and 8, a plurality of filler head assemblies 110 a through f are shown connected to a base 130 by upright supports 131, lateral supports 132 and filler head supports 133. A plurality of such filler head assemblies (with six being illustrated) are adjustably mounted on the filler head support bar 133. Since it is desirable that the machine be capable of accomodating different sizes of bottles, it is preferred that the filler head assemblies be moveable along support bar 133, although this is not required. The relationship between filler head assemblies 110*a* through f in relation to the base 130 is fixed during operation of the machine. A lifting mechanism such as a jackulator is mounted on base 130 so as to lower or raise a tray assembly 135. A pair of skirts 136A and 136B extend upwardly and downwardly in front of and in back of the tray assembly 135, and are mounted to the tray assembly 135 by means not shown. The skirt 136A is shown partially cut away in FIG. 8 in order that other structures may be seen. Mounted on tray assembly 135 is a continuous belt assembly 137 driven by a controlled motor (not shown). As shown best in FIG. 7, a feed continuous belt system 138 is provided adjacent the upstream (left) end of the continuous belt system 137. A take-off continuous feed belt assembly 139 is positioned adjacent the downstream end of the continuous feed belt 137. A feed stop and counter 140 is associated with the feed belt assembly 138. In addition to or instead of the stop and counter 140, a worm screw 143 may be provided to release bottles from continuous feed belt 138 onto continuous feed belt 137 in a controlled fashion. Alternatively, the worm screw 143 shown in FIG. 7 may perform both the function of releasing bottles from the feed continuous belt system 138 to the vertically moveable conveyer system 137 and the aligning function. A system of guide bars 142, 144 and 145 (associated with conveyers 137, 138 and 139, respectively) are used to horizontally restrict the movement of the bottles when conveyed by conveyer systems 137, 138 and 139 to precise patterns. Preferably, guide bars 142 are fixed to tray assembly 135 so as to be vertically moveable therewith. Aligner bar 146 is positioned behind and slightly above the top belt level of the conveyer system 137 with a series of ripples apart from each other spaced the same distance as the distance between feed tube assemblies 110 a through f. While aligner bar 146 may be vertically fixed in relation to the base 130, it is preferred that aligner bar 146 be horizontally moveable by piston system 147 which, in turn, is attached and therefore vertically moveable with tray assembly 135.

The operation of this machine is as follows. Beginning from the position shown in FIGS. 7 and 8, a plurality of bottles 125*a* thru 125*f* are aligned beneath feed tube assemblies 110*a* thru f by aligner bar 146 which is extended forward by pistons 147 so as to hold bottles 125*a* thru f between the ripples in aligner bar 146 and either the worm screw 143 or the guide bar 142 or both. Lift mechanism 134 then lifts tray assembly 135 a predetermined distance, thereby also lifting continuous belt system 137 and the bottles 125*a* through f support thereon as well as the aligning means defined by aligner bar 146 and worm screw 143 and guide bars 142. Lift mechanism 134 is adjusted, according to the height of the bottles, to lift the tray 135 by a length sufficient to cause each bottle to move upward and surround the main portion of each feed tube assembly so as to assume the configuration shown in FIG. 5. At this point, the solenoid 121 of each assembly 110*a* thru 110*f* is actuated so as to open each valve 120 and admit liquid into each bottle until the predetermined level is sensed, whereupon the flow of liquid stops. After a time sufficient for all bottles to have been filled or in response to a signal that all solenoids 121 have closed all valves 121, the lift mechanism 134 then lowers the tray assembly 135 from the raised position as shown in FIG. 9 to the lowered position shown in FIG. 8. At this point, the aligner bar 146 is retracted by pistons 147, the stop 141 is retracted and continuous conveyer system 137 is reactuated (along with worm screw 143 if present) so as to convey bottles 125*a* through 125*f* off of the conveyer system 137. The configuration of guide bars 142 and 145 is such as to cause each bottle to be carried onto continuous take-off belt system 139 which is still moving and carried to a station where each bottle is capped. The actuation of conveyer system 137 is accompanied by the retraction of stop 140 or the starting of a feed worm screw such that a second plurality of bottles represented in FIG. 7 by bottle 125*a'* are delivered by conveyer system 137 to the position previously occupied by bottles 125*a* through *f*. If a feed worm screw is employed with sufficient precision to cause each bottle to be directly beneath a filler tube assembly, then lifting may then commence. Preferably, an aligner bar 146 is present which is then extended by pistons 147 so as to exactly align the bottles 125*a'* through 125*f'* beneath the filler head assemblies 110*a* through 110*f*.

Various modifications are contemplated in above machine such as sets of twelve rather than six filler heads.

We claim:

1. An apparatus for automatically filling bottles with high purity liquid which comprises:

(a) a first plurality of filler head assemblies each defining a liquid feed channel extending vertically downward to a second plurality of circumferentially spaced, outwardly opening apertures and also defining an inert gas feed channel extending vertically downward adjacent the liquid feed channel to a lower end below the outwardly opening apertures;

(b) a vertically moveable platform beneath said first plurality of filler head assemblies;

(c) bottle delivery means for delivering and aligning a first plurality of bottles onto said vertically moveable platform with the opening of each bottle being aligned beneath the apertures and said lower end of a corresponding filler head assembly without contact being made between the bottle and the filler head assembly;

(d) lift means for lifting said vertically moveable platform when said first plurality of bottles are aligned beneath said first plurality of filler heads upwardly until each lower end and associated second plurality of apertures is within a bottle without contact being made between the bottle and the filler head assembly;

(e) liquid feed means for delivering liquid to and through said liquid feed channel and said outwardly opening apertures into each bottle when said vertically moveable platform is raised; and (f) inert gas means for delivering of flow of inert gas at substantially constant pressure through each said inert gas feed channel and for sensing back pressure of said inert gas and for shutting off the flow of liquid to the adjacent liquid feed channel at a location remote from said filler head assemblies when back pressure of inert gas caused by the liquid level in a bottle reaching said lower end is sensed.

2. The apparatus of claim 1 wherein said bottle delivery means is vertically fixed to said vertically moveable platform to move vertically therewith.

3. The apparatus of claim 1 wherein said bottle delivery means comprises an aligner bar defining a first plurality of recesses horizontally spaced each from the adjacent recess by a distance corresponding to the vertical spacing between adjacent filler head assemblies.

4. The apparatus of claim 3 wherein said aligner bar is vertically fixed to said vertically moveable platform to move vertically therewith.

5. A method for automatically filling bottles with high purity liquid without generating particulate contamination which comprises delivering and aligning a first plurality of bottles beneath a first plurality of filler heads, lifting the first plurality of bottles until the lower end of each filler head is received within a bottle without contact being made between a filler head and a bottle, thereby avoiding the generation of particulate contamination by such contact, feeding liquid to and through each filler head into the corresponding bottle, sensing when a selected level of liquid is reached in each bottle and shutting off the flow of liquid to each filler head at a location remote from the filler head when the liquid level in the corresponding bottle has reached the selected level, whereby the generation of particulate contamination by moving parts in the filler head is avoided.

6. The method of claim 5 wherein each filler head comprises a liquid feed channel and an inert gas feed channel and said sensing step comprises feeding an inert gas at substantially constant pressure through said inert gas feed channel to a point at the selected level and sensing back pressure in said inert gas feed channel when the liquid level reaches the selected level.

* * * * *

UNITED STATES PATENT AND TRADEMARK OFFICE

CERTIFICATE OF CORRECTION

PATENT NO. : 4,279,279

DATED : July 21, 1981

INVENTOR(S) : William R. Schevey, Robert G. Weslowski and John D. Morentz

It is certified that error appears in the above-identified patent and that said Letters Patent are hereby corrected as shown below:

Col. 5, line 32, "through 4 of" should read -- through 4 or --.

Col. 5, line 60, "jackulator " should read -- mechanical actuator --.

Signed and Sealed this

*Thirteenth* Day of *April 1982*

[SEAL]

*Attest:*

GERALD J. MOSSINGHOFF

*Attesting Officer*

*Commissioner of Patents and Trademarks*